United States Patent [19]

Barnetche

[11] 4,154,312

[45] May 15, 1979

[54] DRILL BIT WITH SINGLE CUTTING HEAD

[76] Inventor: Eduardo Barnetche, Culiacan No. 123 Desp. 1308, Mexico 11 D.F., Mexico

[21] Appl. No.: 800,916

[22] Filed: May 26, 1977

[51] Int. Cl.[2] ..... E21B 9/08

[52] U.S. Cl. ..... 175/228; 175/353; 175/354; 175/367; 175/370

[58] Field of Search ..... 175/354, 228, 370, 376, 175/367, 353, 348

[56] References Cited

U.S. PATENT DOCUMENTS

| | | | |
|---|---|---|---|
| 1,334,632 | 3/1920 | Pickin | 175/228 |
| 1,859,948 | 5/1932 | Zublin | 175/348 |
| 2,336,335 | 12/1943 | Zublin | 175/354 |
| 2,336,337 | 12/1943 | Zublin | 175/370 |
| 2,598,518 | 5/1952 | Dufilho | 175/376 |
| 3,193,028 | 7/1965 | Radzimovsky | 175/228 X |
| 3,476,195 | 11/1969 | Galle | 175/228 |
| 3,935,911 | 2/1976 | McQueen | 175/228 |

*Primary Examiner*—William Pate, III
*Attorney, Agent, or Firm*—Armstrong, Nikaido, Marmelstein & Kubovcik

[57] ABSTRACT

A rotary drill for drilling a well in the surface of the earth the drill comprising a drill bit including an upper portion for connection to a drill string, duct means for carrying fluid to extract detritus and clear the bottom of the well and receiving means; a solid cutting head comprising a conical head portion and a stem portion, the conical head portion including holes therein and cutting elements inserted in the holes, the stem portion being received in the receiving means of the drill bit, wherein the stem and the receiving means include holding means for rotatably holding the cutting head in the drill bit; bearing means between the drill bit and the conical head; and a lubrication system interconnected between the drill bit and the cutting head.

9 Claims, 6 Drawing Figures

DRILL BIT WITH SINGLE CUTTING HEAD

BACKGROUND OF THE INVENTION

The present invention relates to a rotary drilling bit for well drilling; and more particularly is related to a new tool to be used with the rotatory drilling method, which presents remarkable differences and advantages over the conventional drilling tools and drills heretofore used.

To provide an idea about the differences and advantages of this new tool, it is considered necessary to describe briefly the drilling bits of the rotatory type which exist in the market.

At present the bits are separated in two big groups, the first one comprising all of those bits which do not have any movable part, which are made from one piece and rotate in an integral form. This type which predominatly scrap or drag the bottom of the well such as the so called "fish tail" bits, wing bits, and diamond bits. With these types the drilling is performed by the rotation and by the application of a determinate weight on the bit in such a manner that the bottom of the well is scraped, and the detritus are drawn into the surface by the circulation of the drilling fluid. These bits are very rarely used at present time, except in very special instances due to the limitations thereof, especially with regard to the drilling of hard formations, principally massive rocks.

The second group relates to bits which have rotating or rolling elements in their lower part; these rolling elements are principally cones with strias or teeth which roll in the bottom of the well by the application of the weight on the bit, the rolling resulting in the crushing of the rock. The crushed formation is drawn into the surface by the circulation of the drilling fluid. The rolling elements in the actual bits always are in a variable number, the more ordinary being those which comprise three cones integrated in only one piece and which can not be disassembled or taken apart and therefore can not be repaired. In fact, the triconical bits are built by manufacturing separately each one of the three cones and its corresponding leg provided with bearings and seals which are individually built, that is each one of the legs is separately built. Then during the manufacturing these three parts are bond by welding, forming a single unit. The bit undergoes a wearing of the teeth of the cones, of the cones themselves, of the seals and of the bearings, and thus after of a certain time, when the failure or the wear of some of these constructive elements occurs, the bit will be totally useless, without the possibility of repairing the result is a large waste of material and work which never can be recuperated. Once some of its elements fail the bit is totally discarded without the possibility of recuperation. Another variation of this type of bit is the so called cross bit which comprises four tooth rollers, cones or rolls arranged in a such manner that two of the rollers are placed along one of the diameters, but without totally cutting the full diameter, only the central part, and the other two rollers are placed at 90° and cut the circumferential part of the well to be drilled. Sometimes these tools were able to be repaired but with a considerable cost, and its efficiency is limited, thus it is very rarely used.

There is another group of drilling bits, known as differential or Zublin bits. These bits are of the single cutting head type, reparable and replaceable, which are up to now practically obsolete because of their poor efficiency and limited use. In fact these bits perform like drag bits because the motion of the cutting heads is rather a wobbling motion instead of a true rolling mechanism. The Zublin simplex bit which has an almost spherical cutting head rotating in an inclined angle of 30 degrees from the vertical produce a scraping and reaming action in an up and down motion combined with some rotation.

SUMMARY OF THE INVENTION

The characteristics of this new invention consist in that instead of being provided with several cutting rollers or cones, it is built in a such manner that a single cutting head is used, but with a true and perfect rolling motion against the bottom of the hole with a crushing milling and grinding action thereby enabling it to drill through any kind of formation including very hard rocks. Besides this cutting head can be easily dismounted from the body of the bit in order to change the constructive elements, such as seals, bearings and the cutter itself, so that the bit body which involves a considerable amount of material and work, can be used practically in an indefinite form, simply changing the constructive elements above mentioned such as the cutting head, bearings and seals. Also different cutting heads with different characteristics can be used to drill appropriately formations with different hardness and characteristics.

Therefore, this new tool involves a considerable advance in the decreasing of the drilling costs, since it is a tool which can be used practically in an indefinite form, changing the constructive elements as the wear is observed, with it being possible to change the rolling devices hereinafter described, and to change of the cutting head itself using the same body, which in case of necessity can be repaired, readjusted and reused.

BRIEF DESCRIPTION OF THE DRAWINGS

For a better understanding of the performing and building of the new tool, attached are drawings in which.

DETAILED DESCRIPTION OF THE PREFERRED EMBODIMENT

Figure 1:
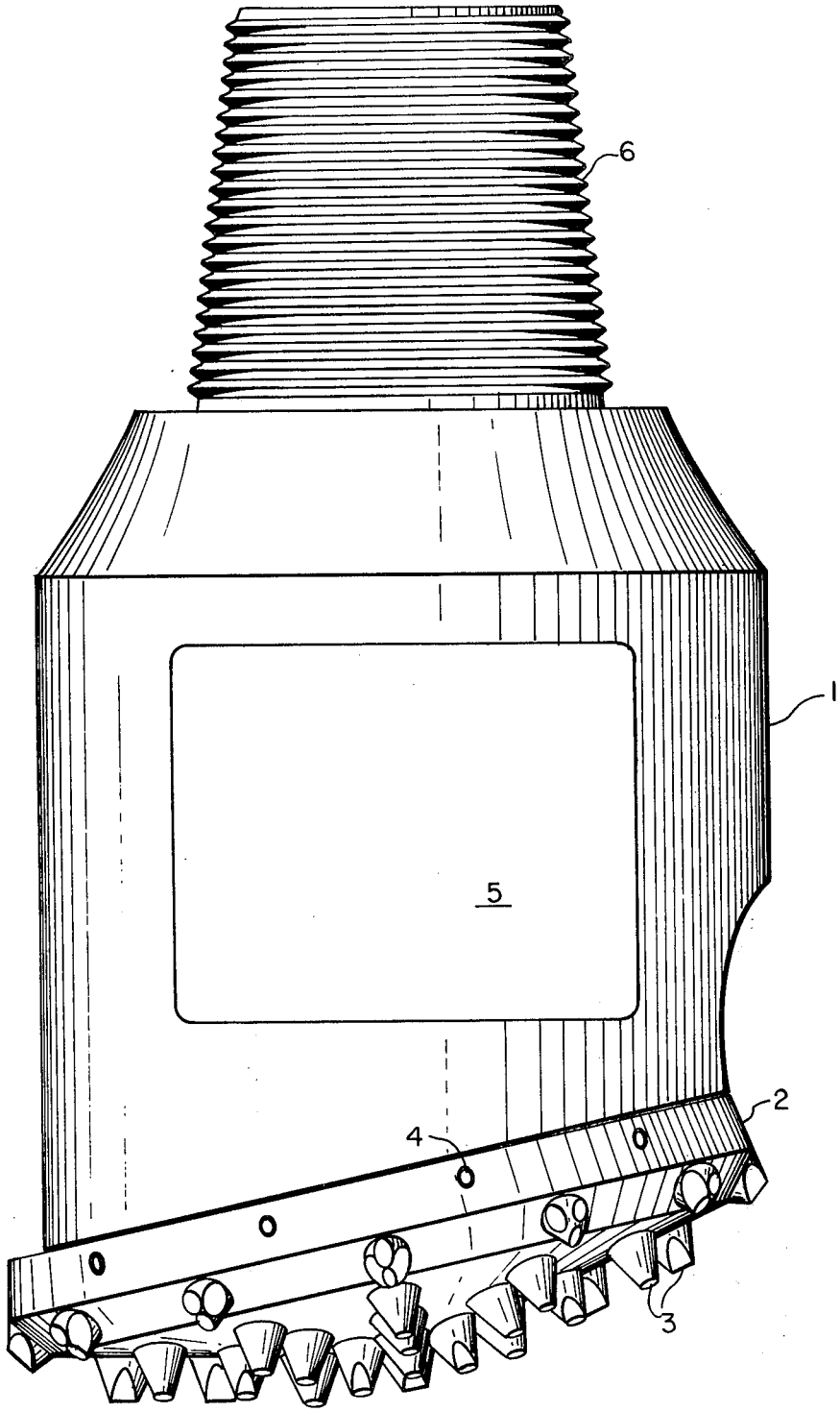
FIG. 1 is a side view of the present invention.

FIG. 1 represents a side view of the full piece. The drill body represented with number 1, is a single piece and its inner construction will be shown in the following figures. The piece number 2 represents the cutting head formed by a cone with certain characteristics that will be described hereinafter, and which penetration or cutting elements of the formation are comprised by teeth represented by the number 3.

The tungston carbide beads represented with the number 4, are necessary parts which avoid the cutting head loss material decreasing its diameter as a result of the friction against the well walls. The portion designated in number 5, represents a square or plane on in both sides of the bit in order to allow its twist through a special key to the rest of the drilling column to which it is fastened by the conical threads 6.

Figure 2:
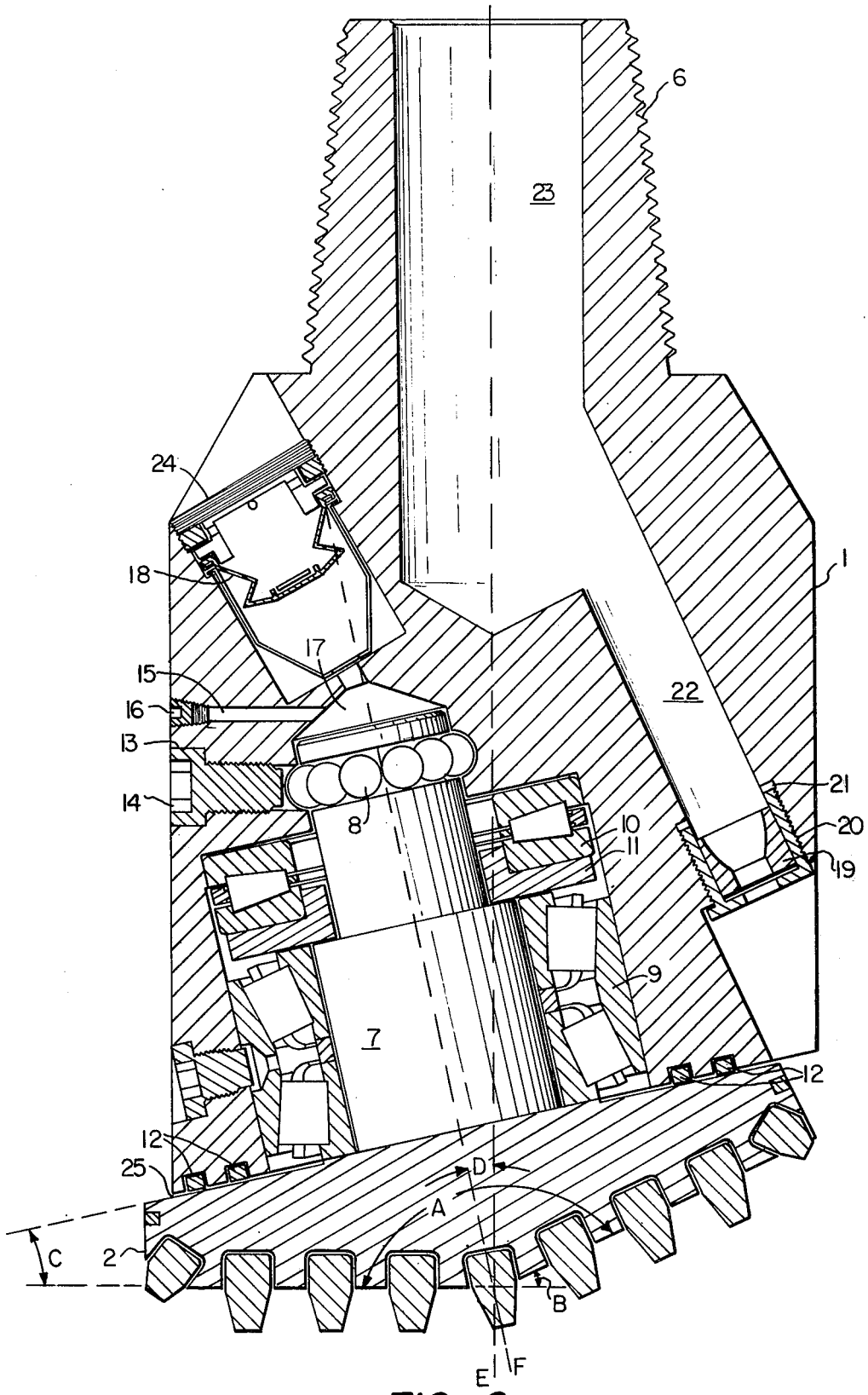
FIG. 2 is a sectional side view showing the present invention.

In the FIG. 2 is illustrated a cross section of the entire tool and its components parts. The cutting head number 2 is formed by a cone which has a very wide vertex, forming an angle represented with the letter A. In the particular case of the drawing, this angle A is 155°, but of course it can vary according to the design and with the drilling of the distinct formations. This cone also has a stem or large shaft illustrated with the number 7 in a such manner that the axis of this cone and its stem represented by the letters F—F, makes an angle with the tools axis represented with the letters E—E. This angle is shown in the drawing with the letter D, and this angle is equal to that formed by the plane of the cone and the horizontal line of the well bottom illustrated with the letter C.

The working of the tool is as follows: upon the rotation of the bit body connected to the drilling column 1, acting through the bearing devices and the shaft of the cutting head or cone 2 to carry out its rolling in the well bottom on generatrixes of this wide cone, in a successive form in a such manner that upon completion of a turn of the body 1, the cone will have carried out its rolling, resting successively its generatrix on the bottom of the well until completion of a little more of a turn since the diameter of the cone is slightly less than the diameter of the hole. In this manner is possible to observe that there is not a scraping or sliding effect between the cone and the well bottom although a perfect rolling is produced since both the cone axis and the body axis just coincide in the cone vertex. Obviously this arrangement which is illustrated in the drawing can be modified forcing a slight displacement of the cone axis into any side, in a manner such that in addition to the rolling, a sliding is produced and, therefore, the drilling is produced both by crushing through a true rolling and by a sliding or scraping of the bottom of the well it being possible modify the design to produce the desired effects.

It can be observed that the cone and its stem or shaft is locked in place through the steel balls device represented with the number 8. This device really forms a hold means or a rotary lock which is obtained by means of a slot with an semi-circular groove in the stem and another s semi-circular groove in the bit body taking into account the necessary mechanical tolerances. The steel balls or bullets are introduced through the orifice shown, and then it is closed or sealed by means of a screw 13 and the check nut 14 so that by means of this arrangement the bullets can be withdrawn, and the cone and the other bearings which will be described hereinafter can be withdrawn for change, readjustment or repair, according to the drilling necessities.

The loads which act on the mechanism by the drilling action will be absorbed or transmitted by means of the roller bearings 9 and 10. Roller bearing 9 absorbs the excentric stresses or moments, or the radial loads, and thrust bearing 10 absorbs the loads and the stress which are axially produced in the action line of the cone axis and its stem illustrated in the drawing with the FF line.

This roller bearings both radial and axial that is 9 and 10; respectively remain assembled and adjusted by means of the thick washer or flange 11, which transmits at same time the axial forces to the thrust roller bearing 10 and adjust the exact position of the roller 9 to fasten it against the upper face of the work cone 2.

It should be noted that the arrangement of these roller bearings can be changed in order to accommodate like roller or ball bearings from several manufacturers of these mechanisms and it also should be noted that in lieu of these roller bearings of the roll type, journal bearings can be used without changing the basic performance of this tool. This mechanical arrangement is always lubricated, and the lubricant is contained within of the internal mechanism spaces retained by the double annular seal 12 wherein a slipping of the flat face against the body is produced, resting exactly on the seals 12 avoiding that the grease leaks to the exterior. At the same time the drilling fluid with the sandy detritus of the crushed material is prevented from penetrating and damaging the internal lubricated mechanism.

The lubricant necessary for the mechanism is supplied through the duct 15 and the duct 17 by means of the grease cup 16 so that all the spaces of the mechanism are filled with the proper lubricant.

The device 18 represents a very useful fitting which is not the subject of this patent and properly is a diphragm through which the stabilization of the internal pressure of the lubricant is obtained. The changes of external pressure when the bit is introduced into the hole or is withdrawn therefrom are balanced by means of this diaphragm and the pressure that the drilling fluid exerts in the interstice 25 such as on equalizing both in the points 25 and 24, the lubricant can not be exhausted and the drilling fluid can not go into the internal mechanisms of the bit. For the disposal of the detritus from the formation or the cuttings produced by the teeth the nozzle 19 is used which is formed by a tungsten carbide piece fastened to the drill body by means of the nut 20 which seals against the drill body through the gasket 21. The the drilling fluid is transmitted through the drill string by the duct 23 and the duct 22 of the nozzle, which at high pressure exhausts a jet between the hole wall and the raised part of the cone 2 with said wall producing the turbulence necessary to withdraw the detritus and clean the well bottom so as the cone teeth of the cutting head always impinge on the clean formation.

Figure 3:
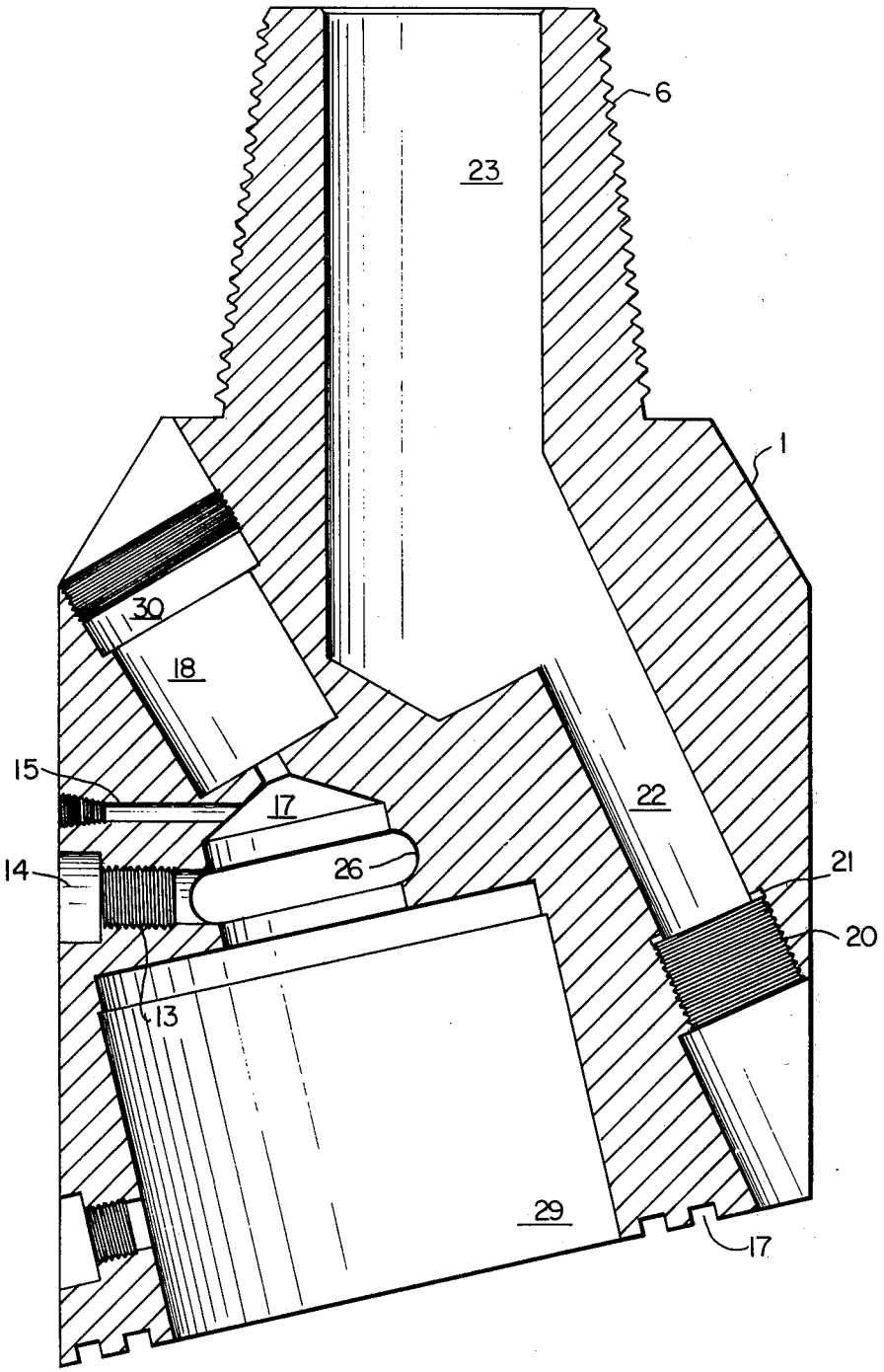
FIG. 3 is a sectional view of the drill bit of the present invention.

FIG. 3 is a longitudinal section view of the the external parts wherein the cutting head is eliminated and is shown with great detail the housing 29 for said cutting head 2. Likewise in the middle portion of the upper region of said housing 29, is illustrated the external surface of the channel 26 wherein are housed the rolling balls with the access hole closed by the nut 13 and the check nut 14.

Although in this figure the greased cup head 16 is not illustrated, the lubricator ducts 15 and 17 are shown with duct 17 contacting the housing 29 for the head, and the diaphragm pressure stabilizer 30.

In the upper central portion of the bit body is large duct 23 which communicates laterally with the duct 22 in the bottom portion of which is the nut 20 and the gasket 21.

Figure 4A:
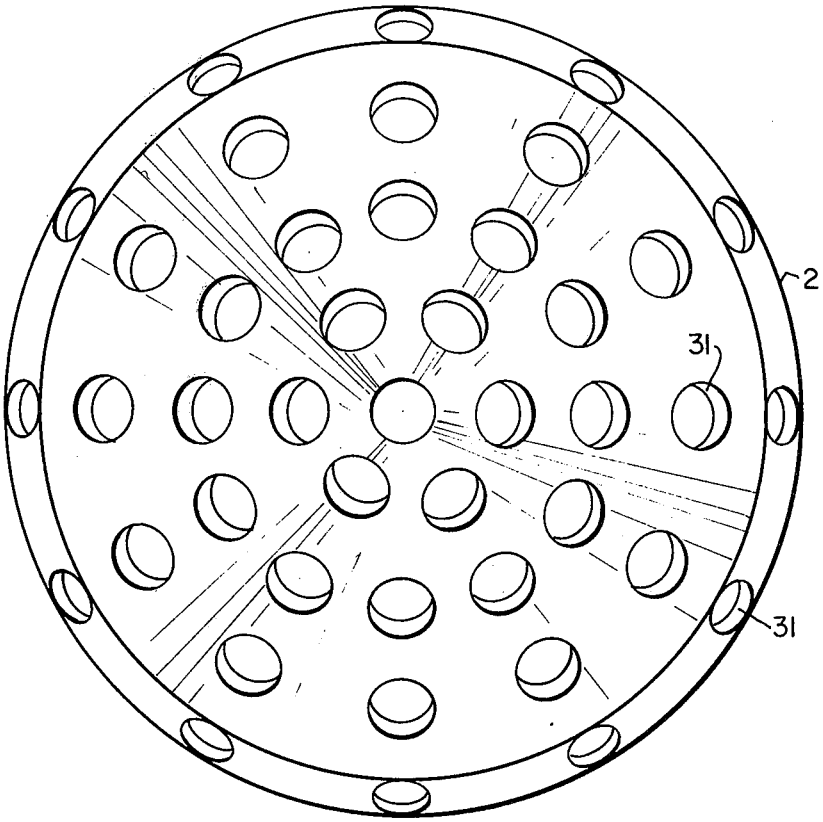
FIG. 4*a* is a bottom view of the cutting head of the present invention.
Figure 4C:
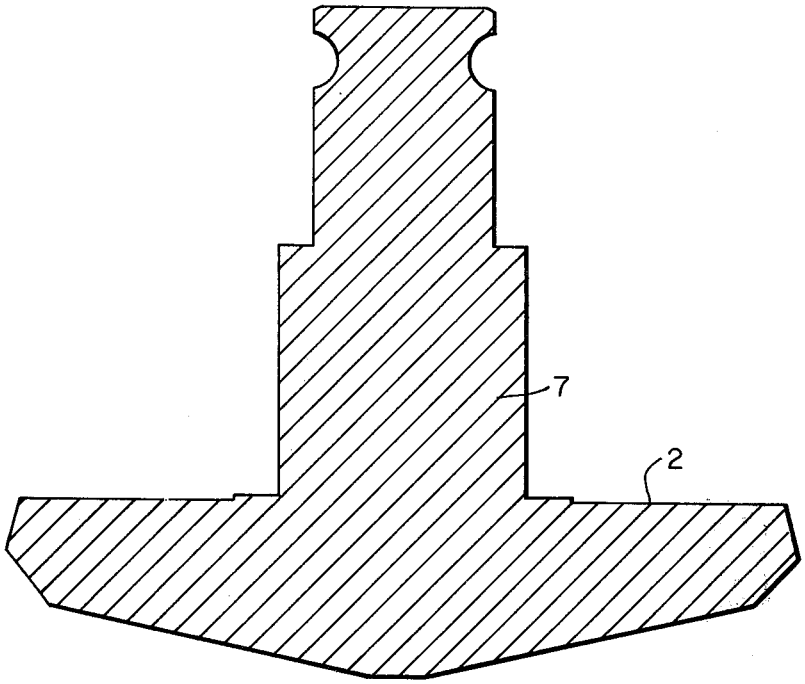
FIGS. 4*b* and 4*c* are sectional views of the cutting head of the present invention.
Figure 4B:
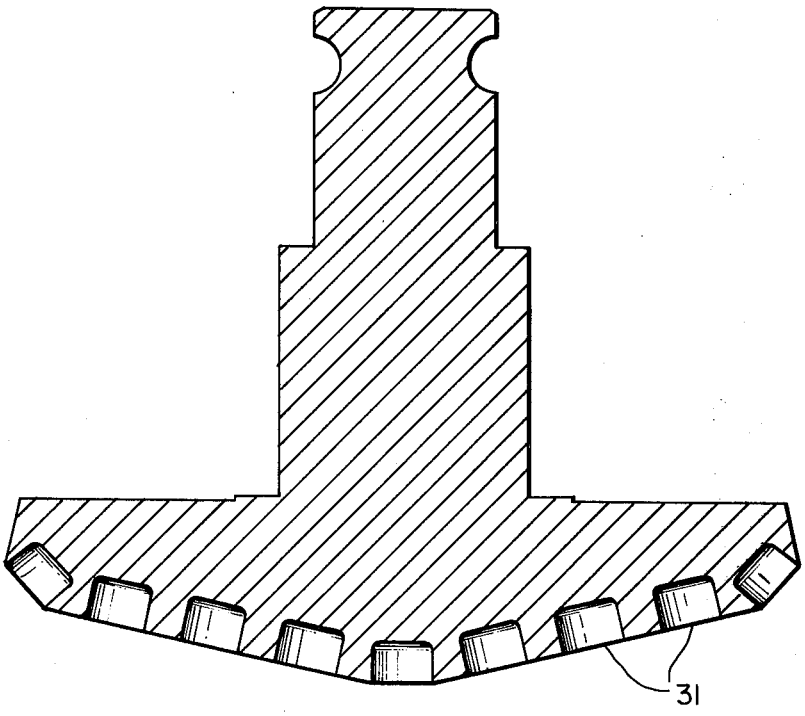

FIG. 4 shows the cutting head No. 2 but the tungsten carbide inserts are not illustrated, being represented only the holes or perforations 31 in which this tungsten carbide teeth will be placed. The arrangement of these inserts can be variable of course in spacing, position etc.

Thus it will be possible to conform the end of the bit for drilling of several types of formations. The emerged portion of the teeth could be larger or shorter, also its spacing in a different form according to the requirements of the drilling of the several formations such as the drilling of sand, granite or clay. Of course, the free elements described in the manufacture of this drill, allow the making of all of the variations necessary for the better working of the piece, according with the formations to be drilled, and therefore the advantage which comprises the ability to change the several cutting heads with different teeth arrangements to obtain precissely the end intended, without the necessity of changing the entire bit as is the case in the prior art.

I claim:

1. A rotary drill for drilling a well in the surface of the earth, said drill comprising:

(a) a drill bit including an upper portion for connection to a drill string, duct means including a fluid outlet into the well for carrying fluid to extract detritus and clean the bottom of the well and receiving means;

(b) a solid cutting head comprising a conical head portion and a unitary stem portion with no internal passages therein, said conical head portion including holes therein and cutting elements inserted in said holes, said stem portion being received in said receiving means of said drill bit, wherein said stem and said receiving means include holding means for rotatably holding said cutting head in said drill bit;

(c) bearing means between said drill bit and said conical head, said bearing means being fixed relative to said drill bit and to said conical head for preventing movement between bearing surfaces of the bearing means which contact the drill bit and conical head and the drill bit and conical head, but allowing said conical head to rotate relative to said drill bit;

(d) a lubrication system, independent of said duct means, interconnected between said drill bit and said cutting head said lubricating system including a stabilizer means for equalizing the pressure in the lubricating system with the pressure in the bore hole surrounding the bit.

2. A rotary drill as set forth in claim 1 wherein said holding means comprises a first groove in said receiving means, a second groove in said stem portion, and a plurality of linking elements positioned in said grooves.

3. A rotary drill as set forth in claim 2 wherein said linking elements are spherical.

4. A rotary drill as set forth in claim 1 wherein said stabilizer means is a pressure stabilizer diaphragm in said drill bit for stabilizing the pressure in said lubrication system to prevent leakage.

5. A rotary drill as set forth in claim 1 wherein said duct means comprises a nozzle for ejecting said fluid said nozzle be positioned within the outer diameter of said drill bit, a main central duct and a smaller duct coupling said main central duct to said nozzle.

6. A rotary drill as set forth in claim 1 wherein said bearing means includes first bearings for bearing axial loads on said conical head and second bearings for bearing radial loads on said conical head wherein the second bearings are located below the first bearing for bearing the radial loads at a point below the point where the axial loads are borne by the first bearings.

7. A rotary drill as set forth in claim 6 wherein said first and second bearings are roller bearings.

8. A rotary drill as set forth in claim 6 wherein said first and second bearings are journaled bearings.

9. A rotary drill as set forth in claim 1 wherein the axis of said drill bit intersects the axis of said conical head at the vertex of the cone of said conical head whereby perfect rolling of the conical head on the bottom of the well is effected.

* * * * *